United States Patent [19]

Roberts et al.

[11] Patent Number: 5,044,100

[45] Date of Patent: Sep. 3, 1991

[54] PHOTOGRAPHIC CASE WITH COVER WITH INTERLOCK MAT

[75] Inventors: Mark H. Roberts, Port Washington; Luis P. Troche, Elmhurst, both of N.Y.

[73] Assignee: Art Leather Manufacturing Co., Inc., Elmhurst, N.Y.

[21] Appl. No.: 616,689

[22] Filed: Nov. 20, 1990

Related U.S. Application Data

[60] Division of Ser. No. 305,736, Feb. 2, 1989, abandoned, which is a division of Ser. No. 861,352, May 9, 1986, Pat. No. 4,825,573, which is a continuation-in-part of Ser. No. 647,128, Sep. 4, 1984, abandoned.

[51] Int. Cl.[5] ..... G09F 1/12

[52] U.S. Cl. ..... 40/159; 40/156; 40/158.1

[58] Field of Search ..... 40/158.1, 159, 159.2, 40/156

[56] References Cited

U.S. PATENT DOCUMENTS

| | | | |
|---|---|---|---|
| 577,676 | 12/1897 | Bartoszewicz | 40/159 |
| 2,177,405 | 10/1939 | Gross | 40/158.1 |
| 2,458,349 | 1/1949 | Cross | 40/158.1 |
| 2,722,071 | 11/1955 | Paschal | 40/158.1 |
| 3,076,279 | 2/1963 | Afton | 40/158.1 |
| 3,237,333 | 3/1966 | Bacharach | 40/156 |
| 3,921,322 | 11/1975 | Sharp | 40/159 |
| 4,033,061 | 7/1977 | Schulhoff et al. | 40/158.1 |
| 4,141,162 | 2/1979 | Mascolo | 40/158.1 |
| 4,184,278 | 1/1980 | Fowinet | 40/158.1 |

FOREIGN PATENT DOCUMENTS

| | | | |
|---|---|---|---|
| 963654 | 7/1964 | United Kingdom | 40/158.1 |

*Primary Examiner*—Michael Safavi

*Attorney, Agent, or Firm*—Lackenbach Siegel Marzullo & Aronson

[57] ABSTRACT

A mounting case for one or more photographs including a cover member and a rim member having an inner stepped edge attached to the inner surface of the cover member and a card member having inner and outer edges attached to the rim member, the inner edge of the card member being spaced slightly more inwardly than the inner stepped edge of the card member so as to form a locking recess between the inner stepped edge of the rim member, the inner surface of the cover member, and the card member. A mounting mat capable of holding a photograph has an outer rim edge that is adapted to lock into the recess against the inner surface of the cover member against the inner stepped edge of the rim member. Once the photograph or photographs are mounted to the mat, the mat is slid by way of a slot into the locking recess. The mat can form a number of cutouts of varied configurations that frame various photographs simultaneously. The case can include one frame with a stand or two, three, or four frames that open to a viewing position or that close to a nonviewing position.

17 Claims, 4 Drawing Sheets

FIG. 1
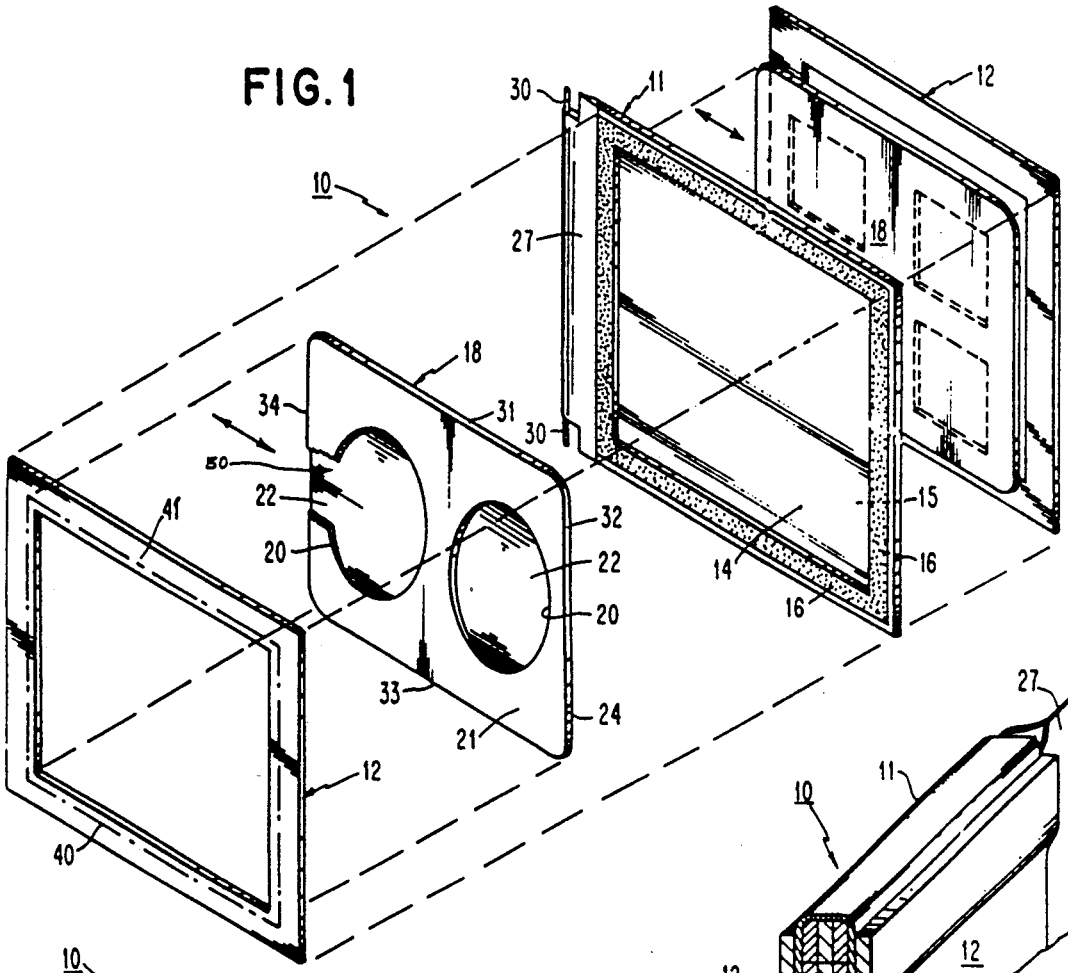
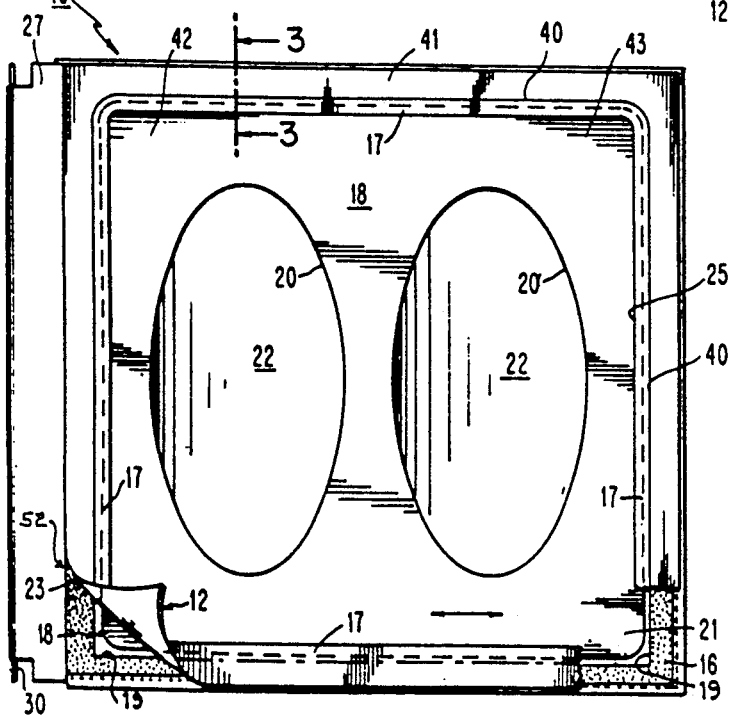
FIG. 2
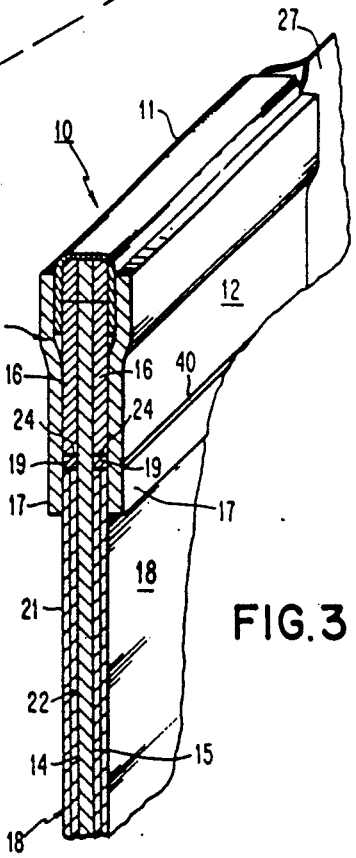
FIG. 3

PHOTOGRAPHIC CASE WITH COVER WITH INTERLOCK MAT

This application is a division of application Ser. No. 305,736, filed 2-2-89, as well as division of our Ser. No. 861,352, filed 5-9-86, now U.S. Pat. No. 4,825,573, which is a continuation-in-part of 647,128, filed 9/4/84, now abandoned.

This is a continuation-in-part application of prior application Ser. No. 647,128 entitled "Photo Album Mounting with Interlock Sleeves".

BACKGROUND AND DISCUSSION OF THE PRIOR ART

This invention relates to photo albums and photo cases. Specifically, this invention relates to a construction for a photo mounting in a photo album or a photo case.

Heretofore, several types of photo album leaf construction were known, such as are discussed in U.S. Pat. No. 2,611,369, granted Sept. 23, 1952 to Herrick; U.S. Pat. No. 2,850,294 granted Sept. 2, 1985 to Ortis et al.; U.S. Pat. No. 4,140,565, granted Feb. 20, 1979 to Parker et al.; U.S. Pat. No. 4,145,830, granted Mar. 27, 1979 to Desmarais et al.; and U.S. Pat. No. 3,461,585, granted August 1969 to R. H. Roberts.

Another conventional photo leaf construction embodying a stepped-edge photo-holding sleeve incorporates a mounting leaf or page with front and back transparent acetate pockets stitched about the outer peripheral portions, with a sleeve being retained in each pocket. The disadvantage of this type of photo leaf construction is that there is no interlock of this sleeve to the mounting leaf or page, nor is the sleeve automatically centers in the pocket. Moreover, acetate absorbs moisture and it is difficult to insert the sleeve into the pocket. Moreover, acetate absorbs moisture and it is difficult to insert the sleeve into the pocket as there is no track-like guide to facilitate accurate positioning and rapid insertion of the sleeve into any desired pocket of an album containing many leaves or pages. The problem with this prior art mounting is that during insertion, the sleeve gets cocked repeatedly as it is being pushed into position in the pocket. The cocking action occurs from corner to corner while the sleeve is forced down into the pocket so as to be fully inserted and positioned or aligned therein. Consequently, this type of leaf construction is not presently in wide use.

Also, in the prior art, it was desired to provide a photo album leaf which gave a finished professional look when the photographs were mounted.

In addition, the prior art shows no interlock of the sleeve with a folio of a photographic case having a photograph mounted to one side of the case with the opposite side being a decorative cover so that the folios of the case can be stood on their bottom ends in a folded manner and set on a table, for example. This observation likewise applies to a single folio case, commonly known as a photographic frame, with a mounting prop or stand at the rear cover.

SUMMARY OF THE INVENTION

In accordance with the present invention, an album leaf is provided which exhibits a professional, finished, customized appearance while eliminating the need for preformed, peel-off adhesive surfaces and simplifying the manufacture and assembly.

It is therefore a principal object of the present invention to provide an improved photo album leaf construction which eliminates the disadvantages of the prior art photo leaf album constructions.

It is another object of the present invention to provide an album leaf construction as aforesaid, in which the need for peelable adhesive portions is eliminated.

It is still a further object of the present invention to provide an album leaf construction as aforesaid which is readily manufactured and mounted with photographs.

It is another object of the present invention to provide a photographic case and a photograpic frame that eliminates the need for peel-off adhesive surfaces.

In summary, a photo album leaf of the invention is formed with a main backing sheet with quadrilateral rim portions bonded to opposite sides of the sheet, with each rim portion forming a step or recess along the inside quadrilateral edge of the rim portion, and a sleeve having a cutout for receiving a photo, and being formed with a stepped peripheral edge, so that when the sleeve is inserted between the rim portion and the backing, the sleeve stepped peripheral edge mates with the rim recessed edge to provide a flush, finished look to the mounted photograph. The invention includes a stiff card that overlies the quadrilateral rim portions and the outer edge of the sleeve so that the sleeve is held in its locking position.

Also, a photographic case with at least one photographic frame having a decorative cover is provided. Each frame member includes a cover member with a backing portion or an attached backing member inside the cover member. A quadrilateral or other shaped rim member is bonded to the inside surface of the cover member forming an inner space defined by an inner stepped edge of the rim member and the inside surface of the cover and adapted to fit a mat mounting a photograph. An overlying stiff card member secured to the rim member forms a recess with the inside of the cover member and the stepped edge of the rim member that is adapted to hold the mat into its interlocked position with the rim member.

The aforesaid as well as other aspects and advantages will become apparent from a reading of the following specification, the adjoined claims and the accompanying drawings.

BRIEF DESCRIPTION OF THE DRAWINGS

FIG. 1 is an exploded perspective view of one leaf of the present invention;

FIG. 2 is a front elevational view of the leaf of FIG. 1;

FIG. 3 is an enlarged fragmented perspective view of a section taken through line 3—3 of FIG. 2;

DESCRIPTION OF THE PREFERRED EMBODIMENTS

Figure 4:
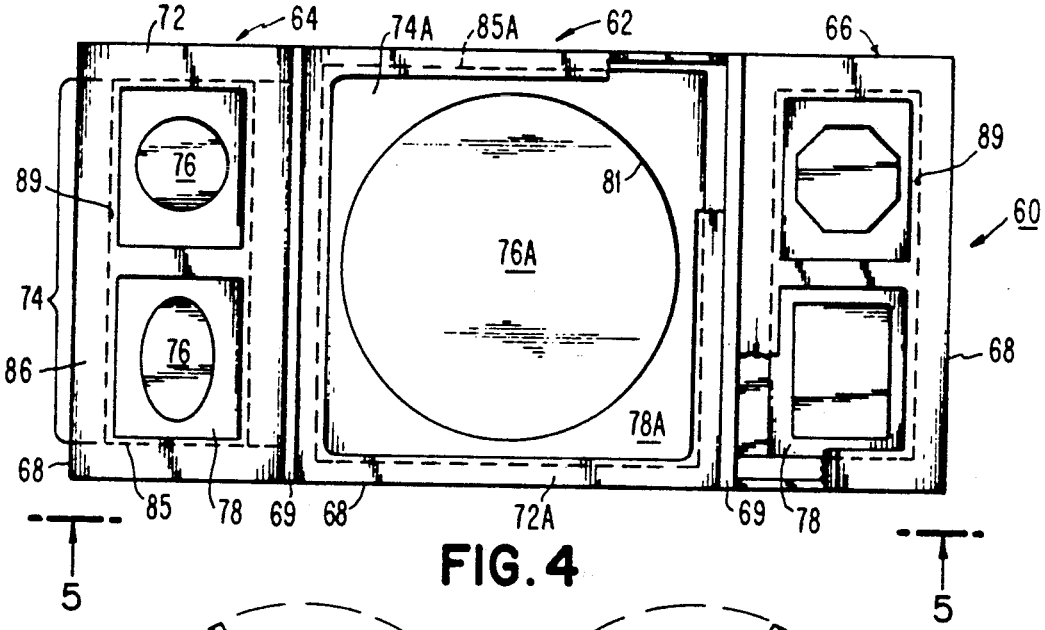
FIG. 4 is a front elevational view of a foldable, three-folio, photographic case with a decorative cover shown in a fully open position.

Reference is now made to the drawings in which similar numerals refer to the same or similar elements.

An album leaf 10 of the present drawing is shown in FIGS. 1 and 2. Album leaf 10, in broad terms, is constructed of a strong, flexible backing sheet 11, with opposed, quadrilateral and relatively stiff rims or rim portions 12 being secured to backing 11 on opposite sides 14 and 15 thereof. Flexible quadrilateral card portions 16, which are smaller in size than the rims 12, form recess 19 under an inner peripheral edge 17 or rim 12 as shown in FIG. 3 suitably adhesively secured to rim portions 12 along three sides as best shown by the stippling in FIGS. 1 and 2. A sleeve 18 comprises an outer member 21 attached to an inner locking member 22 that is sized to fit in slot 23 between rim 12 and card portion 16. Outer member 21 of sleeve 18 is provided with at least one cutout 20, shown oval by way of exposition, suitably gold-trimmed about the cutout portion. Members 21 and 22 may be suitably bonded on two sides 31 and 33 and are free at opposite edges 32 and 34 to form a slot 50 to receive photos (not shown) for display in the oval portions. If desired, three edges may be bonded about a single cutout 20. In fitting sleeve 18, the entire peripheral sleeve edge 24 matches and snugly mates with the four corners of rim recess 19 to provide a flush appearance at the mating exterior surface 25.

With such an album leaf construction, a professional finished look is obtained and the sleeve 18 is automatically locked into place about all four sides thereof as it is guided into place when inserted beneath card portions 16 and set against rim portions or quadrilateral rims 12. Opposing sides of rim recess 19 act as a track-like guide for sleeve 18, and once fully inserted into position via slot 50 beneath the inner edge of card portion 16, sleeve 18 slips into recess 19 and is then automatically locked into position and is thereby fixed in place and precluded from moving. Moreover, sleeve 18 is automatically centered and aligned in the album leaf or page so that the cutouts 20 are positioned in a proper orientation and direction.

For a professional photographer or other user, the invention is particularly advantageous as various stock sleeves having different arrays of cutouts can be separately purchased for future application and use. Once the photographer sets the many photographs in place in the various type sleeves, it then becomes a simple job to organize and create an album of pictures, with the only remaining function being insertion of the many sleeves into the pockets of each album leaf page.

A mounting wire 30 is held by a tape 27 to backing 11 to mount leaf 10 in a photo album in a manner similar to that shown and described in U.S. Pat. No. 3,469,333, granted Sept. 30, 1969, to R. H. Roberts (Roberts '333 patent"). The disclosure of the Roberts '333 patent is incorporated herein by reference thereto, including the gold edge trim stitched to the rim portions and backing sheet 11.

It is important to note that a scored portion 40 of rim 12 permit edge 17 to flex somewhat so as to readily receive sleeve stepped edge 24 in recess 19.

It is also important to note that the outer surfaces 41 and 42 of card portion 16 and sleeve 18, respectively, are similarly textured, as indicated at 43, so that in the flush mounting of the sleeve to the rim and backing, there is a contoured, finished look to the photograph mounted leaf.

It should also be recognized that the securing means for bonding the various elements of the mounting leaf together may comprise one of more conventional means for attaching, such as adhesives, stitching, and the like. Also, suitable colored edging of strong tape or plastic-like material may be folded over and stitched or cemented to the rims and backing sheet to form a gilt edging to each leaf or page.

With the above exposition of the embodiment of FIGS. 1-3 in mind, a further discussion of other embodiments of the invention will now be set forth.

Figure 5:
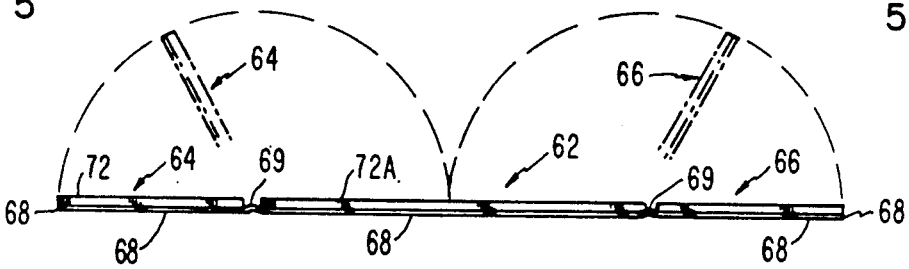
FIG. 5 is a bottom view of the case taken through line 5—5 of FIG. 4.
Figure 6:
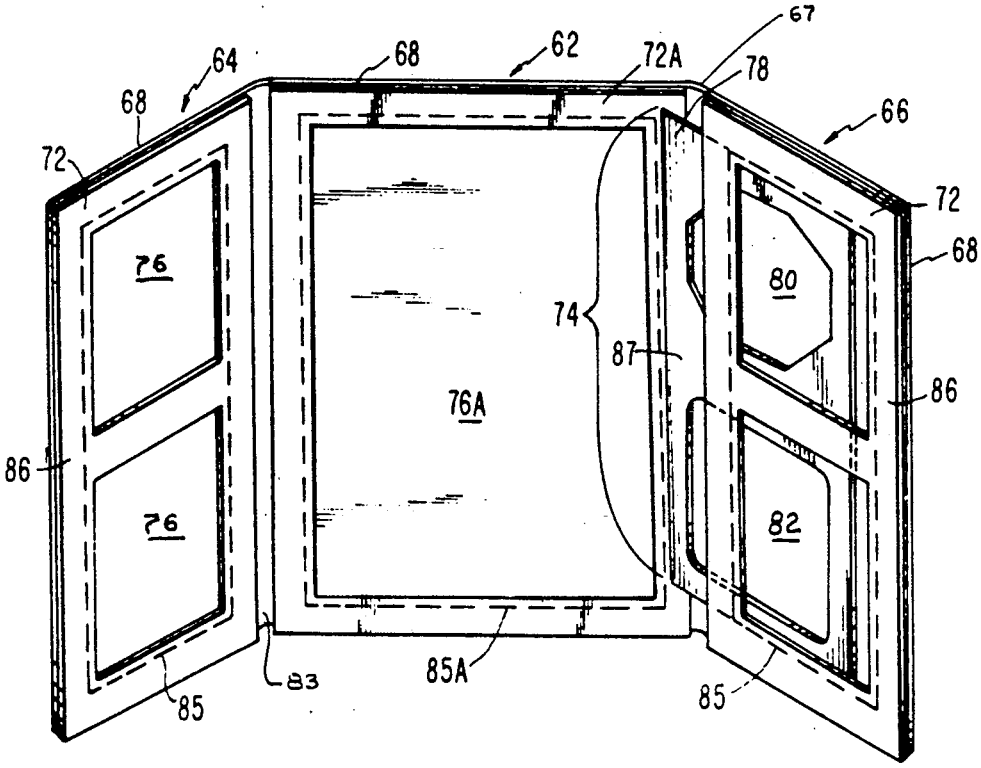
FIG. 6 a perspective view of the photographic case shown in FIGS. 4 and 5 in a partly folded position with a mat being inserted into the left folio.
Figure 9:
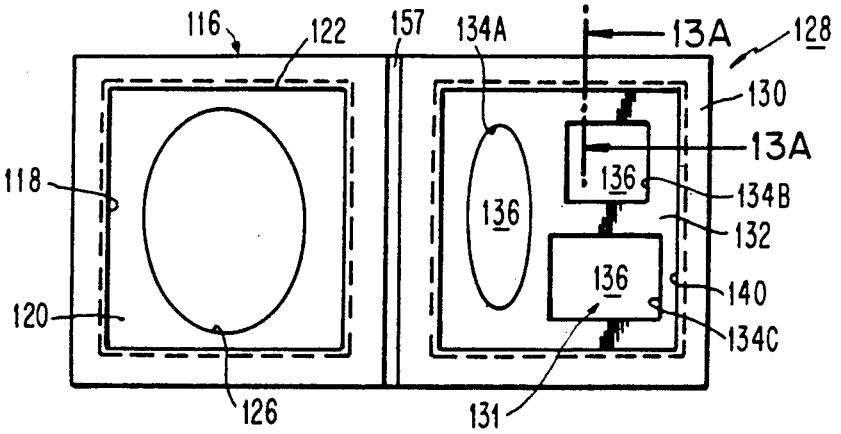
FIGS. 9–12 are front views of a foldable, two-folio photographic case having a mat with three different cutout configurations positioned or being positioned in a folio in four different orientations.

FIGS. 4, 5, and 6 show frontal and bottom views of a photo case 60 that includes a quadrilateral, single, large center frame member, or folio, 62 rotatably attached to a quadrilateral folio 64 shown on the left in FIG. 4 and to a second quadrilateral folio 66 shown on the right. Folios 62, 64, and 66 are in their open position and set upon a flat surface in a position to be viewed. Folios 64 and 66 are each about half the size of center folio 62. Folios 62, 64 and 66 are movable to a closed position wherein folios 64 and 66 are folded over so as to just cover center folio 64. An outer cover 68 seen in FIG. 5 covers case 60. As will be described later in relation to detailed views of the invention, a decorative flexible covering material 67 covers outer cover 68. Although case 60 is shown extending straight in FIGS. 4 and 5, left and right folios 64 and 66 can bend along center folio 62 at thin vertical bending lines 69 so that case 60 can be stood upright as shown in FIG. 6, or can bend further along lines 69 so that the two side folios can close across center folio 62 so that each covers half of the center folio. The flexible connecting portions between left folio 64 and center folio 62 and between center folio 62 and right folio 66 is preferably an extension of covering material 67.

Because left and right folios 64 and 66 are similar, the description that follows will be directed only to left folio 64 and to some extent to center folio 62. A U-shaped sealing trim (not shown) extends around the outer edge of cover 68. A quadrilateral, stiff card rim 72 is attached by suitable means such as gluing to the inner surface of cover 68 so that it extends around the periphery of folio 64. A quadrilateral mounting mat 74 adapted to mount one or more photographs (not shown) is removably mounted inside of card rim 72. Mat 74 has a thickness the same as the thickness of card rim 72. Mat 74 includes an inner flat portion 76 and an outer flat portion 78 that forms upper and lower cutouts 80 and 82, respectively, which are configured as a hexagon and a square, respectively. Mat 74 has an outer mat edge 87. Mat 74 is insertable into, or removable from, a slot 89 formed between the backing sheet adjoining cover 68 and card rim 72. Mat 74 can be inserted through a mat side opening. generally shown as mat slot opening 83. Inner and outer portions 76 and 78 are attached together by suitable means, such as by gluing, with an area left unglued between them forming slots (not shown) that are adapted to pass photographs into or from the cutouts 81 and 82.

FIG. 6, which does not show mats for center and right folios 62 and 64, illustrates mat 74 being inserted into a locked position along inner locking edge 85 of a quadrilateral stiff rim 86 analogous to stiff rim 12 of the embodiment shown in FIGS. 1-3. Mat 74, as before explained, is also kept in position in the space defined by inner locking edge 85 by card rim 72, which overlays mat 74. Stiff rim 86 is secured by suitable means, such as by gluing, to card rim 72.

Center folio 62 includes the same general elements as left folio 60, including a card rim 72A, a mat 74A including inner locking portion 76A and an outer portion 78A that forms a cutout 81 analogous to cutouts 80 and 82 of left mat 72. Mat 74A is locked in position with locking edges 85A of stiff rim portion 86A.

Figure 7:
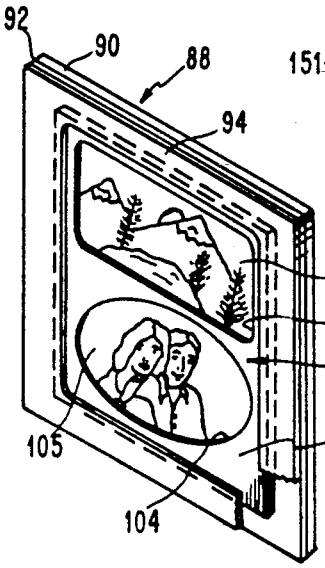
FIG. 7 is a perspective view of the front of a single photographic frame with a decorative cover having a mat with two cutouts containing two pictures.
Figure 8:
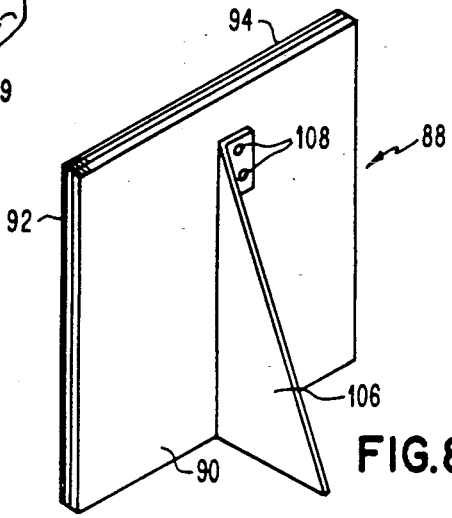
FIG. 8 is a perspective view of the rear of the frame shown in FIG. 7.

In another embodiment of the present invention that shows a photo frame having a mat forming two cutouts each of which can contain a portrait, for example, is seen in FIGS. 7 and 8, which illustrate a single picture frame 88, which includes a cover 90 adjoining a peripheral trim 92, a mat 96, the outer portion 100 only of which is seen, with mat 96 forming an upper rectangular landscape mode cutout 102 containing a portrait 103 and a lower oval cutout 104 containing a portrait 105, and a rotatable triangular prop or stand 106 secured to cover 90 by studs 108. It is to be noted that mat 96, being rectangular, can be reversed and placed under card 94 into the stiff locking rim (not shown) that is mounted to frame 88 so that rectangular cutout 102 is positioned below and oval cutout 104 is positioned above.

FIGS. 9-12 illustrate a photo case 114 having a left folio 116 with a left card 118 and a left mat 120 fitted into the locking rims of a left inner locking rim 122.

The right folio 128 includes a square rim 130 forming a square cutout with a square mat 131 that forms three separate cutouts, namely, oval cutout 134A, square cutout 134B, and rectangular cutout 134C. Inner backing member 136 of mat 131 can be seen through the cutouts. Square mat 131 fits under rim 130 against the square configuration of locking edges of the locking card 140. Oval cutout 134A is disposed at the left of the folio, square cutout 134B is disposed at the top of the folio, and rectangular cutout 134C is disposed at the bottom of the folio. Backing member 152 can be seen in part behind the incoming mat 131.

Figure 10:
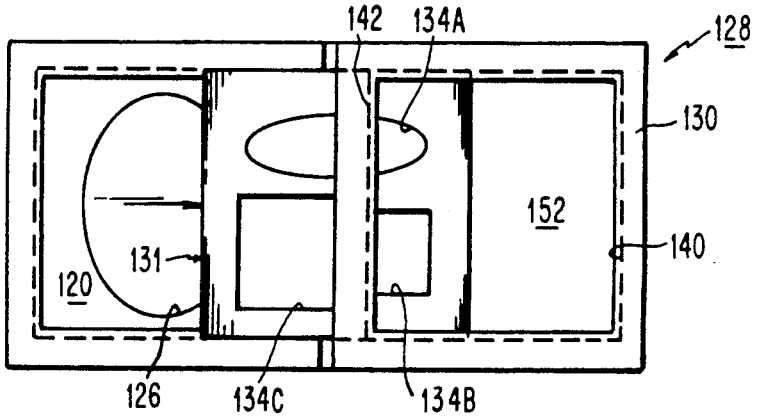

FIG. 10 illustrates photo case 114 with mat 131 rotated clockwise at right angles and being inserted under rim 130 against stiff locking card 140 through a vertical slit 142 at the inner side of the case. Here oval cutout 134A is disposed at the top of the folio, rectangular cutout 134C is disposed to the left of the folio, and square cutout 134C is disposed to the bottom right.

Figure 11:
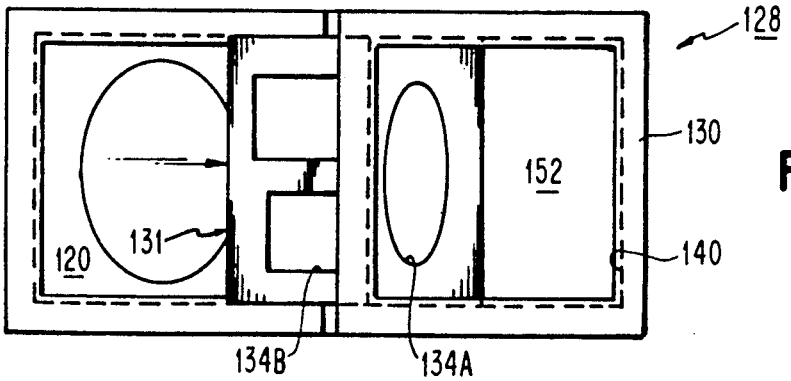
Figure 12:
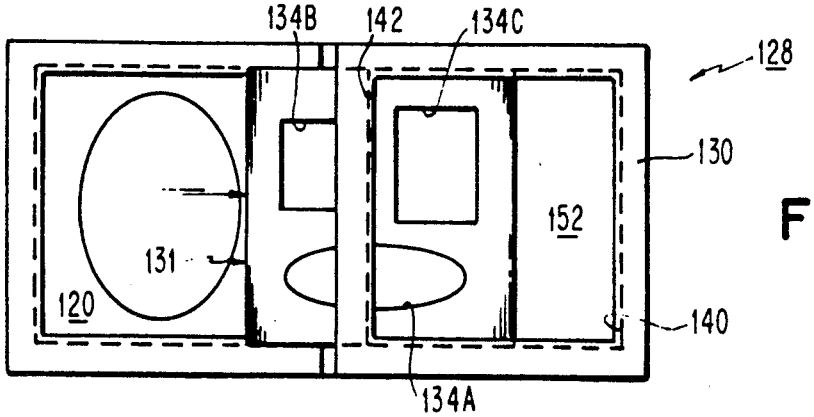

FIGS. 11 and 12 show mat 131 being entered through slit 142 at successive 90 degree clockwise rotations with oval cutout 134A, rectangular cutout 134B, and square cutout 134C being likewise rotated to successive positions 90 degrees from their prior positions. Thus, FIGS. 9-12 illustrate a single mat 131 that can be adapted to a variety of positions.

Figure 13A:
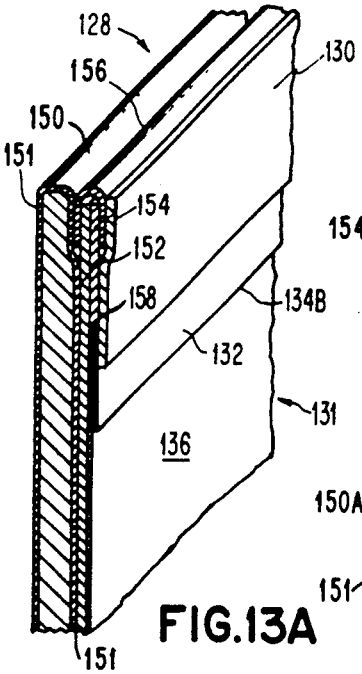
FIG. 13A is a fragmented perspective view of a section taken through line 13A—13A of FIG. 9 that includes a backing sheet.
Figure 13B:
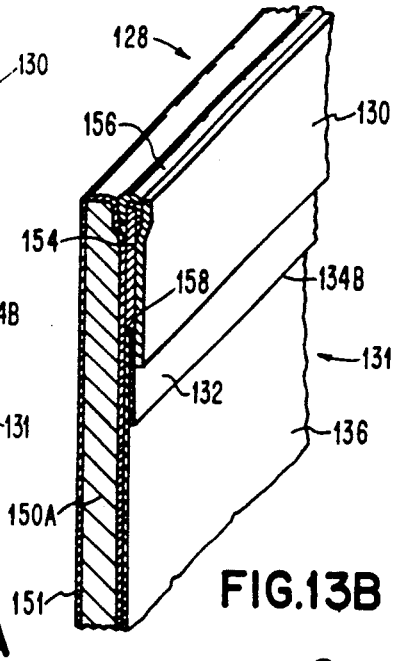
FIG. 13B is a fragmented perspective view of a section analogous to that taken for FIG. 13A that includes only a stiff cover without a backing.

FIGS. 13A, 13B, 13C, and 13D are partial sections taken through the top of folio 128 that show four different possible configurations of the elements that comprise photo case 114. FIG. 13A is a section of photo case 114 with a backing; and FIG. 13B is a section of photo case 114 without a backing but having a stiff cover. In particular, FIG. 13A shows a cover member 150 covered over its outer surface by a flexible decorative covering material 151 with its inner surface bonded or otherwise connected to the outer surface of a stiff backing sheet 152 having an inner surface. Stiff backing sheet 152, being nonremovably secured to cover member 150, can be considered a portion of cover 150. A stiff locking card 154 is glued or bonded or otherwise connected to the inner surface of backing sheet 152. A peripheral U-shaped trim 156 is mounted around both backing sheet 152 and locking card 154. Stiff rim 130 is suitably secured to locking card 154 so as to overlay locking edge 158 of locking card 154 so as to define a slot between rim 130 and backing sheet 152 into which slot the periphery area of mat 131 is inserted and held against locking edge 158. Outer member 132 of mat 131 forms cutout 134B, which can be seen in the partial section. In particular, inner backing member 136, which backs mat outer member 132 of mat 131, adjoins backing sheet 152 against which mat 131 is slid during mounting against stiff locking card 154.

FIG. 13B shows a stiff cover 150A that also performs as a backing sheet and against which mat 131, particularly inner backing member 136, is positioned. Peripheral trim 156 here is primarily decorative and is positioned around the edge of locking card 154, which is directly secured by gluing or other suitable means to the inner surface of stiff cover 150A. The rim 130 is secured to locking card 154 in the same manner. Mat 131 is slid into position against locking edge 158 of locking card 154 between stiff cover 150A and rim 130.

Figure 13C:
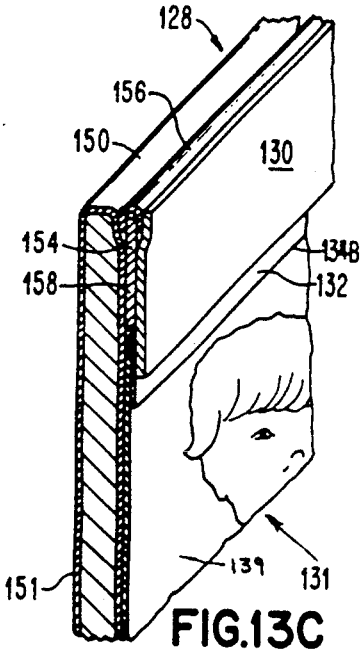
FIG. 13C is a fragmented perspective view of a section analogous to that taken for FIG. 13A that shows a backless mat.

FIG. 13C shows an embodiment similar to that shown in FIG. 13A but with mat 131 comprising only mat outer member 132 without mat inner backing member 136. A photograph 139 is shown suitably attached to the rear of mat outer member 132.

Figure 13D:
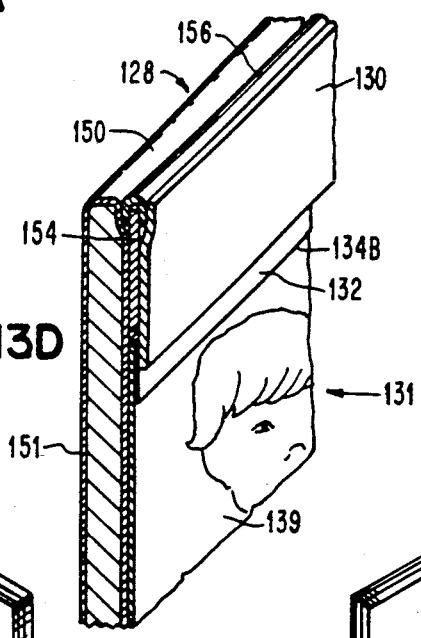
FIG 13D is a fragmented perspective view of a section analogous to that taken for FIG. 13A that shows an embodiment with a stiff cover without a backing with a backless mat and holding a photograph.

FIG. 13D shown an embodiment similar to that shown in FIGS. 13B and 13C with mat 131 comprising only mat outer member 132 without any mat inner backing member and with frame stiff cover 150A also performing for the backing sheet.

Figure 14:
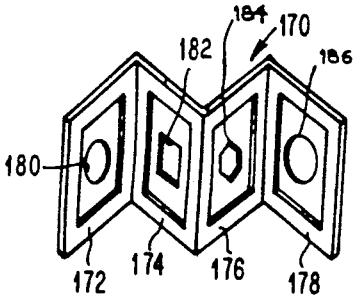
FIG. 14 is a perspective view of a photographic case with four folios.

FIG. 14 illustrates a photo case 170 having four folios 172, 174, 176, and 178 shown in an angled relationship for standing but which are adapted to completely fold up one against the other or which can be spread out flat as the situation arises. Mats 180, 182, 184, and 186 are respectively mounted in the folios named with each mat forming a different cutout configuration.

It will be obvious to those skilled in the art that without departing from the spirit and scope thereof, and therefore the invention is not limited by that which is shown in the drawings and described in the specification, and as indicated in the appended claims.

What is claimed is:

1. A photograph mounting system, comprising, at least one frame member including cover means having opposed inner and outer sides and a cover peripheral edge, a rim member secured to said inner side of said cover and having a rim inner peripheral edge and a rim outer peripheral edge, said rim outer edge being generally coextensive with said cover peripheral edge, said rim inner peripheral edge and said inner side defining a space, a card member secured to said rim member and having card inner and outer edges, said card outer edge being generally coextensive with said rim outer edge, said card inner edge being configured the same as and extending less inwardly than said rim inner edge, said rim inner edge, said card member, and said inner side of said cover means forming an inner peripheral recess, said inner peripheral recess extending around the entire length of the cover means, mat means for holding the photograph for viewing said mat means having a peripheral edge and being adapted to be received within said space and positioned in locking relationship with said rim inner peripheral edge, said cover means providing a backing for said mat means, slot means formed between said card member and said rim member for allowing passage of said mat means to and from said space, and the entire peripheral edge of the mat matching and snugly mating with the entire length of the inner peripheral recess, whereby said mat is locked into place along its entire peripheral edge within said inner peripheral recess.

2. The system of claim 1, wherein said mat means includes a flat mat mounting member having inner and outer mat sides and forming at least one cutout adapted to provide a viewing frame for a photograph, said mat mounting member being positioned in said space with said inner mat side in contact with said inner side of said cover means, said mat mounting member including an outer mat edge locked in a recess disposed along said rim inner stepped edge.

3. The system of claim 2, wherein said system is adapted to include a plurality of photographs and said at least one cutout includes a plurality of cutouts adapted to provide a plurality of viewing frames for said plurality of photographs.

4. The system of claim 1 wherein said mat means further includes a mat backing member secured to said inner mat side, said mat mounting member and said mat backing member forming at least one sleeve adapted to hold a photograph, and further including entry means for allowing passage of a photograph into and from said at least one sleeve.

5. The system of claim 4, wherein said at least one sleeve is a plurality of sleeves for holding a plurality of photographs, and said entry means is for allowing passage of each of said plurality of photographs into each of said plurality of sleeves.

6. The system of claim 3, wherein said rim member, said rim inner stepped edge, and said mat edge are rectangular.

7. The system of claim 6, wherein said rim member, said rim inner stepped edge, and said mat edge are square, whereby said mat mounting member can be aligned in said space and locked in said recess in four different viewing alignments.

8. The system of claim 3, wherein said cover means includes at least one cover member having a stiff backing portion including said cover peripheral edge and having opposed inner and outer surfaces, said rim member being secured to said inner surface.

9. The system of claim 8, said at least one cover member further including an outer portion secured to said outer surface of said stiff backing portion.

10. The system of claim 3, wherein said cover means further includes a flexible, decorative covering material secured to said outer side.

11. The system of claim 8, wherein said at least one frame member is a plurality of frame members, each of said plurality of frame members being rotatably connected to at least one other adjacent frame member, said plurality of frame members including at least two end frame members, said mounting system being movable between open and closed positions, wherein in said open position each said cutout is viewable and said mounting system is capable of being placed in an upright position on a surface, and in said closed position said plurality of frame members are folded one against the other.

12. The system of claim 8, wherein said one frame member includes mean for holding said one frame member upright upon a surface, said means for holding being connected to said outer side of said one frame member.

13. The system of claim 11, further including connecting means for rotatably securing said adjacent frame members.

14. The system of claim 13, wherein said connecting means is said flexible covering material.

15. The system of claim 2, wherein said slot means is a slot formed along a portion of said rim member, said slot being adapted to pass said mat means into said space into locking relationship with said stepped edge.

16. The system of claim 1, further including a U-shaped trim secured to at least said card outer peripheral edge.

17. A photograph mounting system, comprising:

at least one planar frame member including planar cover means having opposed inner and outer sides and a cover peripheral edge, a planar, flexible rim member secured to said inner side of said cover and having a rim inner peripheral edge and a rim outer peripheral edge, said rim outer edge being generally coextensive with said cover peripheral edge, said rim inner peripheral edge and said inner side defining a space, a planar card member secured to said planar rim member and having card inner and outer edges, said card outer edge being generally coextensive with said rim outer edge, said card inner edge being configured the same as and extending less inwardly than said rim inner edge, said rim inner edge, said planar card member, and said inner side of said planar cover means forming an inner peripheral recess, said inner peripheral recess extending around the entire length of the planar cover means, planar mat means for holding the photograph for viewing said planar mat means having a peripheral edge and being adapted to be received within said space and positioned in locking relationship with said rim inner peripheral edge, planar slot means formed between said planar card member and said planar, flexible rim member for allowing passage of said mat means to and from said space, and the entire peripheral edge of the mat matching and snugly mating with the entire length of the inner peripheral recess, whereby said mat is locked into place along its entire peripheral edge within said inner peripheral recess.

* * * * *

UNITED STATES PATENT AND TRADEMARK OFFICE

CERTIFICATE OF CORRECTION

PATENT NO. : 5,044,100

DATED : September 3, 1991

INVENTOR(S) : Mark H. Roberts et al

It is certified that error appears in the above-identified patent and that said Letters Patent is hereby corrected as shown below:

Claim 1, in column 7, line 21, change "card member to --- cover means ---.

Claim 17, in column 8, lines 59-60, change "card member" to --- cover means ---.

Signed and Sealed this

Thirtieth Day of March, 1993

*Attest:*

STEPHEN G. KUNIN

*Attesting Officer*

*Acting Commissioner of Patents and Trademarks*